US009673032B1

(12) United States Patent
Schleifer et al.

(10) Patent No.: US 9,673,032 B1
(45) Date of Patent: Jun. 6, 2017

(54) SAMPLE SPRAYER WITH ADJUSTABLE CONDUIT AND RELATED METHODS

(71) Applicant: Agilent Technologies, Inc., Santa Clara, CA (US)

(72) Inventors: Arthur Schleifer, Portola Valley, CA (US); Nigel P. Gore, San Jose, CA (US)

(73) Assignee: Agilent Technologies Inc., Santa Clara, CA (US)

( * ) Notice: Subject to any disclaimer, the term of this patent is extended or adjusted under 35 U.S.C. 154(b) by 0 days.

(21) Appl. No.: 15/087,312

(22) Filed: Mar. 31, 2016

(51) Int. Cl.

| | |
|---|---|
| ***H01J 49/10*** | (2006.01) |
| ***H01J 49/04*** | (2006.01) |
| ***H01J 49/14*** | (2006.01) |
| ***H01J 49/34*** | (2006.01) |

(52) U.S. Cl.
CPC ..... *H01J 49/045* (2013.01); *H01J 49/145* (2013.01); *H01J 49/34* (2013.01)

(58) Field of Classification Search
CPC .... H01J 49/0404; H01J 49/165; H01J 49/167; H01J 49/10
USPC ..... 250/281, 282, 283, 288
See application file for complete search history.

(56) References Cited

U.S. PATENT DOCUMENTS

| | | | | |
|---|---|---|---|---|
| 5,233,156 | A | 8/1993 | Chan et al. | |
| 6,166,379 | A | 12/2000 | Montaser et al. | |
| 7,106,438 | B2 | 9/2006 | Morrisroe et al. | |
| 7,671,329 | B2 | 3/2010 | Sakata et al. | |
| 8,272,576 | B2 | 9/2012 | Doak et al. | |
| 8,431,888 | B2 | 4/2013 | Kennedy et al. | |
| 2008/0142704 | A1* | 6/2008 | Whitehouse | H01J 49/167 250/288 |
| 2008/0237372 | A1* | 10/2008 | Scheer | B05B 7/066 239/418 |
| 2011/0204223 | A1* | 8/2011 | Nakano | H01J 49/0495 250/288 |

OTHER PUBLICATIONS

Banerjee, Shibdas, et al, Electrospray Ionization Mass Spectrometry: A Technique to Access the Information Beyond the Molecular Weight of the Analyte, International Journal of Analytical Chemistry, Review Article, Nov. 9, 2011, pp. 1-41, vol. 2012, Article ID 282574, Hindawi Publishing Corporation.

Kuster, Simon K., et al, High-Resolution Droplet-Based Fractionation of Nano-LC Separations onto Microarrays for MALDI-MS Analysis, Analytical Chemistry, American Chemical Society, Apr. 11, 2014, pp. 4848-4855, vol. 86, ACS Publications.

(Continued)

*Primary Examiner* — Nicole Ippolito

(57) ABSTRACT

A sample sprayer includes a first conduit for conducting a liquid sample, a second conduit surrounding the first conduit to define an annular passage for conducting a gas, a sprayer tip in which a fluid interaction region receives the liquid sample and the gas. The sprayer tip is configured to produce a sample spray by contact between the liquid sample and the gas in the fluid interaction region and emit the sample spray from the orifice. An adjustable positioning device is configured to translate the first conduit along the longitudinal axis in response to adjustment of the positioning device, wherein an axial position of the first conduit is adjustable relative to the orifice.

20 Claims, 7 Drawing Sheets

(56) References Cited

OTHER PUBLICATIONS

Li, Qiang, et al, Fraction Collection from Capillary Liquid Chromatography and Off-line Electrospray Ionization Mass Spectrometry Using Oil Segmented Flow, NIH Public Access, Author Manuscript, Analytical Chemistry, Jun. 15, 2010, pp. 5260-5267, vol. 82(12).

Li, Xiaohui, et al, A simplified electrospray ionization source based on electrostatic field induction for mass spectrometric analysis of droplet samples, The Royal Society of Chemistry, 2012, pp. 5743-5748, vol. 137.

Nie, Jing, et al, Capillary liquid chromatography fraction collection and postcolumn reaction using segmented flow microfluidics, Journal of Separation Science, 2013, pp. 3471-3477, vol. 36, Wiley-VCH Verlag GmbH & Co.

Pei, Jian, et al, Rapid Analysis of Samples Stored as Individual Plugs in a Capillary by Electrospray Ionization Mass Spectrometry, NIH Public Access, Author Manuscript, Analytical Chemistry,Aug. 1, 2009, pp. 6558-6561, vol. 81 (15).

Pei, Jian, et al, Rapid and Label-Free Screening of Enzyme Inhibitors Using Segmented Flow Electrospray Ionization Mass Spectrometry, American Society for Mass Spectrometry, 2010, pp. 1107-1113, Elsevier, Inc.

Schneider, Thomas, et al, The Potential Impact of Droplet Microfluidics in Biology, Analytical Chemistry, American chemical Society, 2013, pp. 3476-3482, vol. 85, ACS Publications.

Silvestre, Cristina I., et al, Liquid-liquid extraction in flow analysis: A critical review, Analytica Chimica Acta, 2009, pp. 54-65, vol. 652, Elsevier B.V.

Su, Yuan, et al, A multifunctional microfluidic droplet-array chip for analysis by electrospray ionization mass spectrometry, Lab on a Chip, The Royal Society of Chemistry, 2013, pp. 1876-1882, vol. 13, RSC Publishing.

Sun, Shuwen, et al, Label Free Screening of Enzyme Inhibitors at Femtomole Scale Using Segmented Flow Electrospray Ionization Mass Spectrometry, Analytical Chemistry, American Chemistry Society, 2012, pp. 5794-5800, vol. 84, ACS Publications.

Sun, Shuwen, et al, Droplet Electrospray Ionization Mass Spectrometry for High Throughput Screening for Enzyme Inhibitors, Analytical Chemistry, American Chemistry Society, 2014, pp. A-F, ACS Publications.

Verboket, Pascal E., et al, A New Microfluidics-Based Droplet Dispenser for ICPMS, Analytical Chemistry, American Chemistry Society, 2014, pp. 6012-6018, vol. 86, ACS Publications.

Volny, Michael, et al, Nanoliter Segmented-Flow Sampling Mass Spectrometry with Online Compartmentalization, Analytical Chemistry, American Chemistry Society, 2014, pp. 3647-3652, vol. 86, ACS Publications.

Hong, Song-Yi, et al., Droplet-based electrospray ionization mass spectrometry for qualitative and quantitative analysis, JMS Letters, Journal of Mass Spectrometry, 2014, pp. 432-436, vol. 49, John Wiley & Sons, Ltd.

Zhu, Ying, et al, Integrated Droplet Analysis System with Electrospray Ionization-Mass Spectrometry Using a Hydrophilic Tongue-Based Droplet Extraction Interface, Analytical Chemistry, American Chemical Society, Oct. 1, 2010, pp. 8361-8366, vol. 82, No. 19.

DePonte et al., Gas Dynamic Virtual Nozzle for Generation of Microscopic Droplet 5 Streams, J. Phys. D: Appl. Phys. 41 195505 (2008).

* cited by examiner

SAMPLE SPRAYER WITH ADJUSTABLE CONDUIT AND RELATED METHODS

TECHNICAL FIELD

The present invention relates generally to generation of a spray via interaction of a liquid stream and a nebulizing gas stream. In particular, the liquid stream may contain sample material that may be analyzed by an analytical instrument. Depending on the application, the sample material may be ionized prior to processing by the analytical instrument.

BACKGROUND

Spray nozzles have been developed that utilize a central tube to carry a liquid and an outer tube, usually concentric with the inner tube, to carry a gas that assists with nebulization of the liquid. The respective outlets of the central tube and the outer tube are positioned relative to each other such that the flow of liquid is merged into the surrounding flow of gas, whereby the stream of liquid through interaction with the stream of gas is broken up and converted to a spray of droplets of the liquid carried by the flow of gas, i.e., an aerosol is created. The resulting spray, or aerosol, may be utilized for a wide range of purposes depending on the application. Of particular interest is the generation of a sample spray, i.e., a spray that contains droplets carrying sample material for which some type of analysis is sought. A sample spray may, for example, provide the sample material for implementing mass spectrometry (MS) or optical emission spectrometry (OES).

One type of sample spraying device is known as a gas dynamic virtual nozzle (GDVN). A GVDN includes a central tube that emits a stream of liquid sample and is surrounded by an outer tube. A flow of gas is established through the annular passage formed between the central tube and the outer tube. The outer tube has a section that converges down to an exit orifice in front of, and at an axial distance from, the exit opening of the central tube. By this configuration, the stream of liquid sample exits the central tube and into a space in which the liquid sample encounters the gas supplied through the annular passage. The interaction between the gas and the liquid sample causes the liquid sample to break up into droplets, with the result that a sample spray emerges from the exit orifice of the outer tube, which serves at the nozzle exit of the GDVN.

Current designs for GDVNs and other sample sprayers are limited by the fact that they either do not provide a way to adjust the position of the central tube relative to the exit orifice or do not provide a way to adjust the position of the central tube while the sample sprayer is operating, i.e., while the gas and liquid flows through the sample sprayer are active. Thus, in current designs optimization of the sample spray is difficult to achieve.

Therefore, there is a need for improvements in the design of sample sprayers.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a sample sprayer includes: a first conduit disposed along a longitudinal axis, the first conduit comprising a first inlet for receiving a flow of a liquid sample, a first outlet for emitting the liquid sample, and a first conduit outer surface; a second conduit surrounding the first conduit about the longitudinal axis, the second conduit comprising a second inlet for receiving a flow of a gas and a second conduit inner surface spaced from the first conduit outer surface, wherein the first conduit and the second conduit define an annular passage for conducting the gas; a sprayer tip comprising a sprayer tip body and a fluid interaction region, wherein: the sprayer tip body comprises an orifice disposed at an axial distance from the first outlet relative to the longitudinal axis; the fluid interaction region is disposed along the longitudinal axis between the first conduit and the orifice, and communicates with the first outlet, the annular passage, and the orifice; and the sprayer tip is configured to produce a sample spray by contact between the liquid sample and the gas in the fluid interaction region and emit the sample spray from the orifice; and an adjustable positioning device mechanically communicating with the first conduit and configured to translate the first conduit along the longitudinal axis in response to adjustment of the positioning device, wherein an axial position of the first outlet along the longitudinal axis is adjustable relative to the orifice.

According to another embodiment, an atmospheric pressure ionization (API) source includes: a sample sprayer according to any of the embodiments disclosed herein; an ionization chamber communicating with the second conduit outlet; and an ionization device configured for ionizing analytes from the sample spray emitted from the second outlet into the ionization chamber at atmospheric pressure.

According to another embodiment, a sample analysis system includes: an API source according to any of the embodiments disclosed herein; and an analytical instrument interfaced with the ionization chamber and configured for measuring an attribute of analyte ions or analyte photons produced by the API source.

According to another embodiment, a method for producing a sample spray includes: flowing a liquid sample through a first conduit, through a first outlet of the first conduit, and into a fluid interaction region of a sprayer tip; flowing a gas through an annular passage between the first conduit and a second conduit surrounding the first conduit and into the fluid interaction region, wherein the gas contacts the liquid sample and produces a sample spray; emitting the sample spray from an orifice of the sprayer tip, wherein the fluid interaction region is disposed along a longitudinal axis and the first outlet is positioned at an axial position along the longitudinal axis relative to the orifice; while emitting the sample spray, translating the first conduit to adjust the axial position of the first outlet relative to the orifice.

According to another embodiment, a method for producing analyte ions includes: producing a sample spray according to any of the embodiments disclosed herein; and ionizing analytes contained in droplets of the sample spray.

According to another embodiment, a method for analyzing a sample includes: ionizing analytes according to any of the embodiments disclosed herein; and measuring an attribute of the ions.

According to another embodiment, a method for atomizing a sample includes: producing a sample spray according to any of the embodiments disclosed herein; generating plasma; and emitting the droplets from the sample spray into the plasma.

According to another embodiment, a method for analyzing a sample includes: atomizing the sample according to any of the embodiments disclosed herein to produce sample atoms; and measuring an attribute of the sample atoms or photons emitted from the sample atoms.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
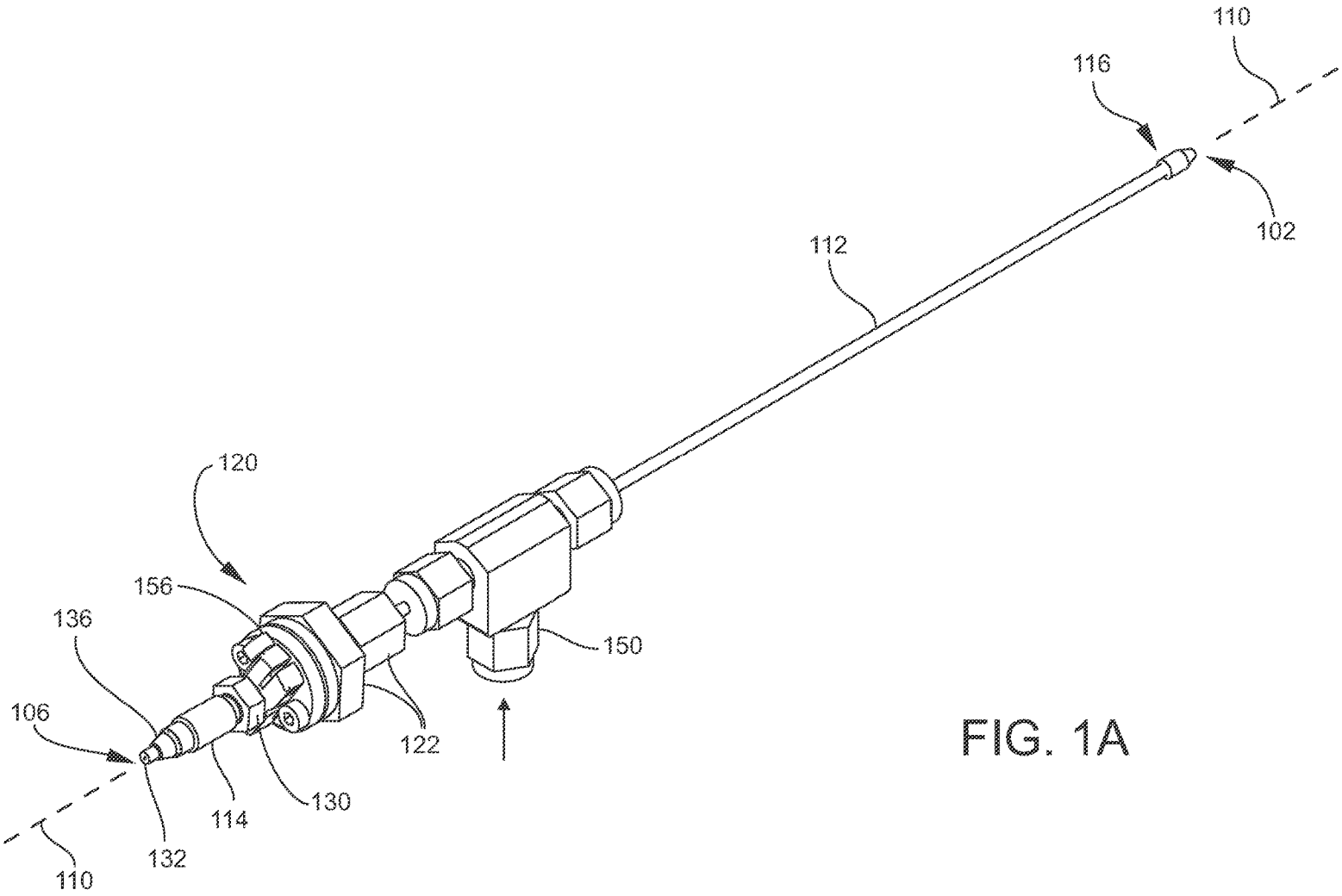
FIG. 1A is a schematic perspective view of a sample sprayer according to some embodiments.

As used herein, the term "fluid" is used in a general sense to refer to any material that is flowable through a conduit. Thus, the term "fluid" may generally refer to either a liquid or a gas, unless specified otherwise or the context dictates otherwise.

As used herein, the term "liquid" may generally refer to a solution, a suspension, a colloid, or an emulsion. Solid particles and/or gas bubbles may be present in the liquid.

As used herein, the term "aerosol" generally refers to an assembly of liquid droplets and/or solid particles suspended in a gaseous medium long enough to be observed and measured. The size of aerosol droplets or particles is typically on the order of micrometers (μm). See Kulkarni et al., Aerosol Measurement, 3$^{rd}$ ed., John Wiley & Sons, Inc. (2011), p. 821. An aerosol may thus be considered as comprising liquid droplets and/or solid particles and a gas that entrains or carries the liquid droplets and/or solid particles. The term "spray" may refer to an aerosol that is being or has been subjected to a mechanism of propulsion.

As used herein, the term "atomization" refers to the process of breaking molecules down to atoms. As one non-limiting example, "atomizing" a liquid sample may entail nebulizing the liquid sample to form an aerosol, followed by exposing the aerosol to plasma.

As used herein, the term "sample" includes one or more different types of analytes of interest dissolved or otherwise carried in a fluid matrix. The analytes may be metals, other elements, (bio)chemical compounds, biopolymers (e.g., carbohydrates, polynucleotides, proteins, etc.), or biological materials such as whole (intact) biological cells, lysed or disrupted cells, or intracellular components. The fluid matrix may be or include water and/or other solvents, soluble materials such as salts and/or total dissolved solids (TDS), and may further include other compounds that are not of analytical interest.

As used herein, the term "atmospheric pressure" is not limited to the standard atmospheric pressure of 760 Torr. Thus, "at" atmospheric pressure encompasses "at or around" or "at about" atmospheric pressure.

As used herein, the term "conduit" generally refers to any type of structure enclosing an interior space that defines a repeatable path for fluid to flow from one point (e.g., an inlet of the conduit) to another point (e.g., an outlet of the conduit). A conduit generally includes one or more walls defining a tube or a channel.

In some embodiments, a conduit may have a small bore. A small-bore tube may be referred to herein as a capillary tube, or capillary. A small-bore channel may be referred to herein as a "microfluidic channel" or "microchannel." The cross-section (or flow area) of a small-bore conduit may have a cross-sectional dimension on the order of micrometers (e.g., up to about 1000 μm, or 1 mm) or lower (e.g., nanometers (nm)). For example, the cross-sectional dimension may range from 100 nm to 1000 μm (1 mm). The term "cross-sectional dimension" refers to a type of dimension that is appropriately descriptive for the shape of the cross-section of the conduit—for example, diameter in the case of a circular cross-section, major axis in the case of an elliptical cross-section, or a maximum width or height between two opposing sides in the case of a polygonal cross-section. Additionally, the cross-section of the conduit may have an irregular shape, either deliberately or as a result of the limitations of fabrication techniques. The cross-sectional dimension of an irregularly shaped cross-section may be taken to be the dimension characteristic of a regularly shaped cross-section that the irregularly shaped cross-section most closely approximates (e.g., diameter of a circle, major axis of an ellipse, width or height of a polygon, etc.). Flow rates through a small-bore conduit may be on the order of microliters per minute (μL/min) or nanoliters per minute (nL/min).

A tube or capillary may be formed by any known technique. The tube or capillary may be formed from a variety of materials such as, for example, fused silica, glasses, polymers, and metals.

A microfluidic channel may be formed in a solid body of material. The material may be of the type utilized in various fields of microfabrication such as microfluidics, microelectronics, micro-electromechanical systems (MEMS), and the like. The composition of the material may be one that is utilized in these fields as a semiconductor, electrical insulator or dielectric, vacuum seal, structural layer, or sacrificial layer. The material may thus be composed of, for example, a metalloid (e.g., silicon or germanium), a metalloid alloy (e.g., silicon-germanium), a carbide such as silicon carbide, an inorganic oxide or ceramic (e.g., silicon oxide, titanium oxide, or aluminum oxide), an inorganic nitride or oxynitride (e.g., silicon nitride or silicon oxynitride), various glasses, or various polymers such as polycarbonates (PC), polydimethylsiloxane (PDMS), etc. The solid body of material may initially be provided in the form of, for example, a substrate, a layer disposed on an underlying substrate, a microfluidic chip, a die singulated from a larger wafer of the material, etc.

The channel may be formed in a solid body of material by any technique, now known or later developed in a field of fabrication, which is suitable for the material's composition and the size and aspect ratio (e.g., length:diameter) of the channel. As non-limiting examples, the channel may be formed by an etching technique such as focused ion beam (FIB) etching, deep reactive ion etching (DRIE), soft lithography, or a micromachining technique such as mechanical drilling, laser drilling or ultrasonic milling. Depending on the length and characteristic dimension of the channel to be formed, the etching or micromachining may be done in a manner analogous to forming a vertical or three-dimensional "via" partially into or entirely through the thickness of the material (e.g., a "through-wafer" or "through-substrate" via). Alternatively, an initially open channel or trench may be formed on the surface of a substrate, which is then bonded to another substrate to complete the channel. The other substrate may present a flat surface, or may also include an initially open channel that is aligned with the open channel of the first substrate as part of the bonding process.

Depending on its composition, the material defining the conduit may be inherently chemically inert relative to the fluid flowing through the conduit. Alternatively, the conduit (or at least the inside surface of the conduit) may be deactivated as part of the fabrication process, such as by applying a suitable coating or surface treatment/functionalization so as to render the conduit chemically inert. Moreover, the inside surface of the conduit may be treated or functionalized so as to impart or enhance a property such as, for example, hydrophobicity, hydrophilicity, lipophobicity, lipophilicity, etc., as needed or desirable for a particular application. Coatings and surface treatments/functionalizations for all such purposes are readily appreciated by persons skilled in the art.

In some embodiments, the material forming the conduit is optically transparent for a purpose such as performing an optics-based measurement, performing a sample analysis, detecting or identifying a substance flowing through the channel, enabling a user to observe flows and/or internal components, etc.

Figure 1B:
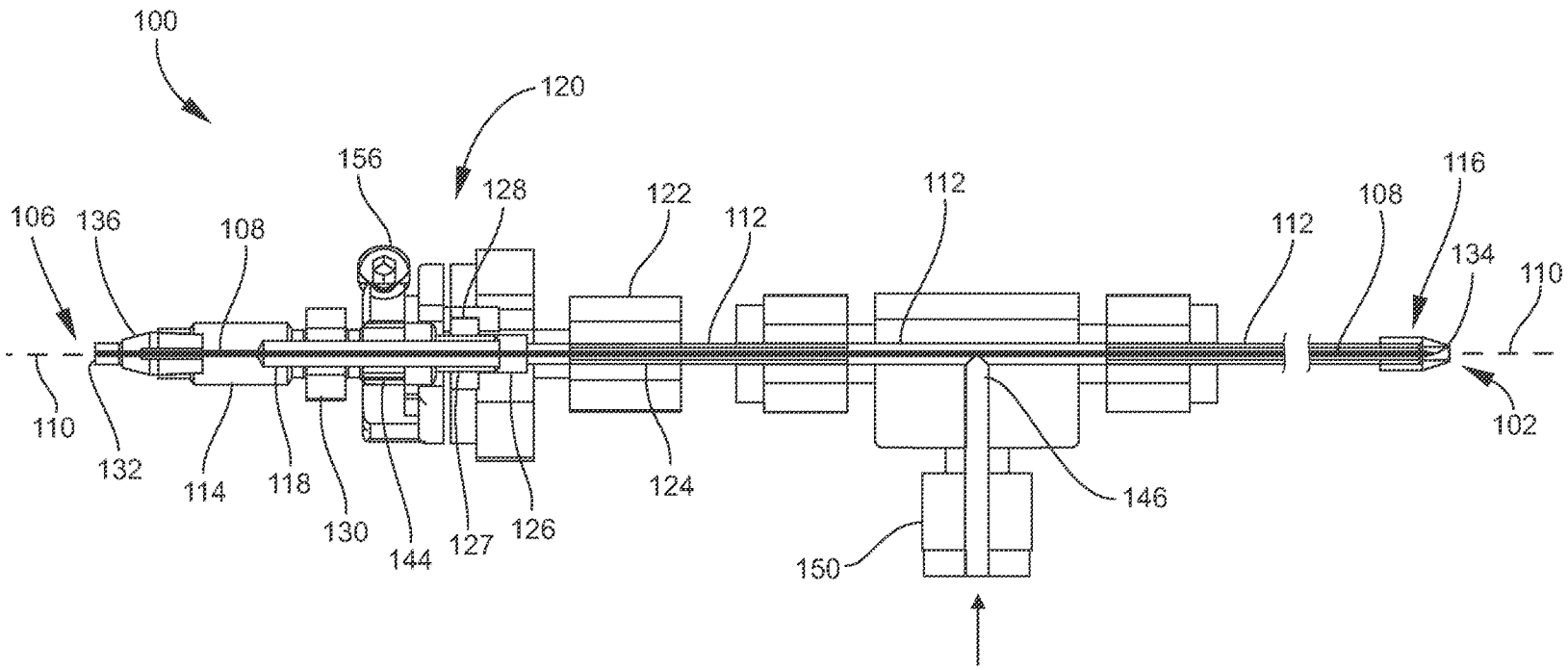
FIG. 1B is a schematic cross-sectional side view (lengthwise) of the sample sprayer illustrated in FIG. 1A.
Figure 1C:
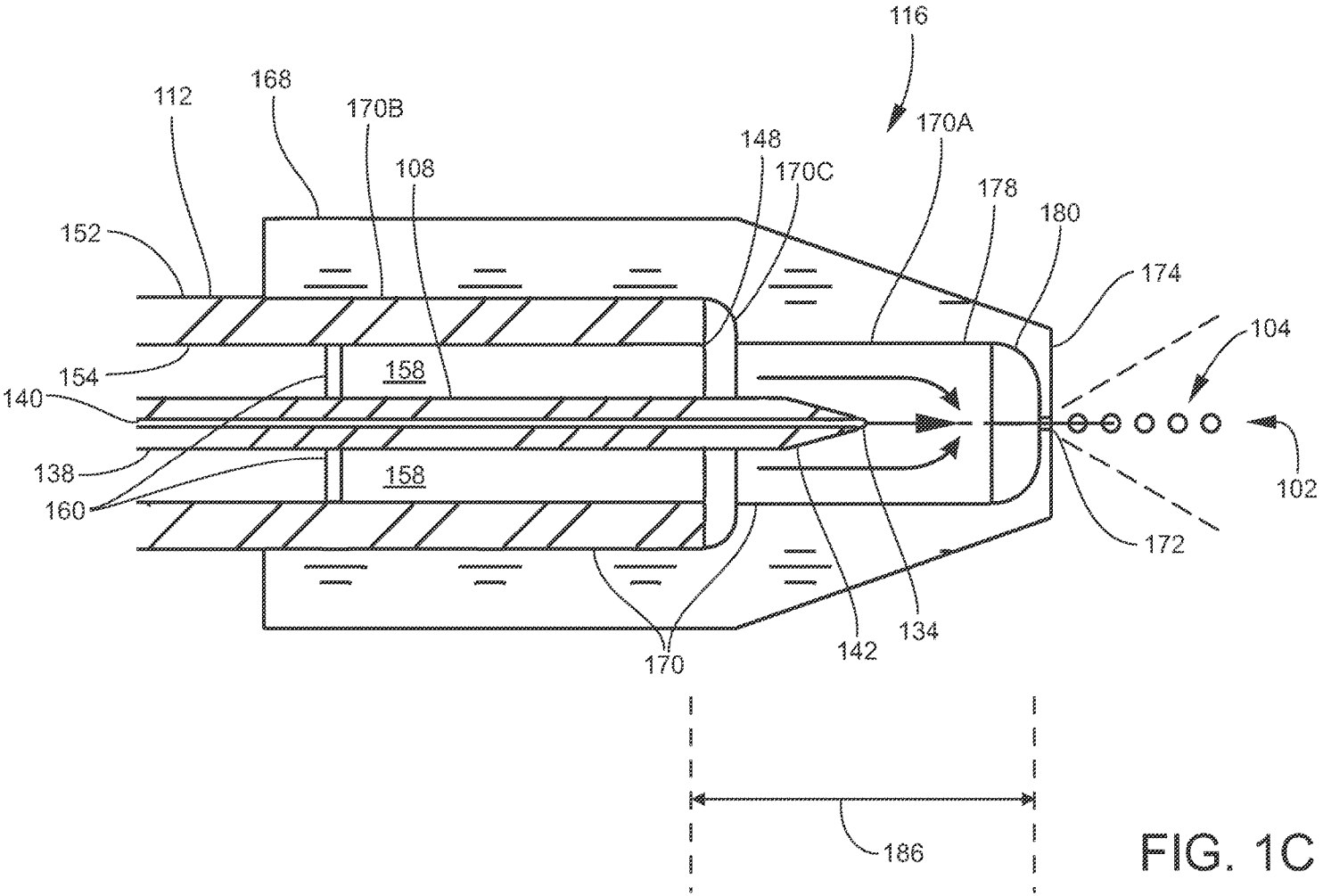
FIG. 1C is a schematic cross-sectional side view (lengthwise) of a sprayer tip of the sample sprayer illustrated in FIG. 1A according to an embodiment.

FIGS. 1A-1C illustrate an example of a sample sprayer 100 according to an embodiment. FIG. 1A is a schematic perspective view of the sample sprayer 100. FIG. 1B is a schematic cross-sectional side view (lengthwise) of the sample sprayer 100. FIG. 1C is a schematic cross-sectional side view (lengthwise) of a distal end section (or front end section) of the sample sprayer 100, i.e., the section that terminates at a distal end (or front end, or tip) 102 of the sample sprayer 100. In the present context, the distal end 102 is the end at which a sample spray 104 (FIG. 1C) is formed and projected outward. The sample sprayer 100 also has a promixal end section (or rear end section), i.e., the section that terminates at a promixal end (or rear end) 106 of the sample sprayer 100. In the present context, the promixal end 106 is the end axially opposite to the distal end 102.

Generally, the sample sprayer 100 may include a first conduit (or inner conduit, or sample conduit) 108 (FIGS. 1B and 1C) disposed (or elongated) along a longitudinal axis 110, a second conduit (or outer conduit, or gas conduit) 112 surrounding the first conduit 108 about the longitudinal axis 110, a sprayer tip (or sprayer tip section) 116 disposed at the distal end 102, and an adjustable positioning device (or axial adjustment device) 120 typically disposed between the distal end 102 and the promixal end 106. In the context of the present disclosure, the term "axial" refers to, or denotes a position relative to, the longitudinal axis 110. In the illustrated embodiment, the first conduit 108 and the second conduit 112 are provided as tubes. Alternatively, one or both of the first conduit 108 and the second conduit 112, or portions of one or both of the first conduit 108 and the second conduit 112, may be channels formed in structural portions of the sample sprayer 100.

For purposes of illustration and description, the longitudinal axis 110 is utilized as a reference datum from which the positions of the various components of the sample sprayer 100 may be defined. The first conduit 108 is located on the longitudinal axis 110, and the second conduit 112 is coaxial with the first conduit 108 relative to the longitudinal axis 110. In the context of the present disclosure, the term "coaxial" is not meant to limit the first conduit 108 and the second conduit 112 to having circular cross-sections, but instead indicates that the first conduit 108 and the second conduit 112 are both located on a common axis, namely the longitudinal axis 110. The first conduit 108 and the second conduit 112 may have other round cross-sections (e.g., elliptical) or may have polygonal cross-sections in other embodiments, as noted elsewhere herein. The first conduit 108, as a general matter, may be considered as being centrally located within the overall structure of the sample sprayer 100. In this case the longitudinal axis 110 may be considered, as least generally, as being the central axis of the sample sprayer 100. However, such configuration does not limit the sample sprayer 100 as a whole to being perfectly symmetrical about the longitudinal axis 110, as evident from the example shown in FIG. 1A.

The first conduit 108 includes a first conduit inlet (or first inlet) 132 (FIGS. 1A and 1B) for receiving a flow of a liquid sample from a sample source, and a first conduit outlet (or first outlet) 134 (FIGS. 1B and 1C) for emitting the liquid sample. The first conduit inlet 120 may be located generally at a point upstream of the sprayer tip 116, such as at or near the promixal end 106 of the sample sprayer 100. In the illustrated embodiment, the first conduit inlet 120 is located on-axis (on the longitudinal axis 110) at the proximal end 106, while in other embodiments may be located at an off-axis position. The first conduit inlet 120 may be fluidly sealed and securely fixed in the bore of a fluidic fitting 136 (e.g., a compression seal fitting, ferrule, etc., FIGS. 1A and 1B) configured to fluidly couple the first conduit inlet 120 in a fluid-sealed manner to another fluid conduit communicating with the sample source.

As illustrated in FIG. 1C, the first conduit 108 includes a first conduit outer surface 138 and a first conduit inner surface 140 defining the thickness of the solid portion (wall) of the first conduit 108 that surrounds the inner bore (or lumen) of the first conduit 108. The first conduit 108 terminates at a first conduit tip 142 at which the first conduit outlet 134 is located. In some embodiments, the first conduit tip 142 is tapered (e.g., conical) as illustrated, whereby the outer diameter of the first conduit 108 tapers down along the first conduit tip 142 to its end face surrounding the first conduit outlet 134. The tapered geometry may be desirable, for example, for improving separation of the liquid flow from the first conduit outlet 134. The inner bore of the first conduit 108 may be constant along the length of the first conduit 108, or at least along the length of the distal portion of the first conduit 108 that terminates at the first conduit outlet 134. Alternatively, the inner bore may vary in steps or taper gradually such as in the illustrated first conduit tip 142.

In a typical yet non-limiting embodiment, the inside diameter (bore diameter) of the first conduit 108 may be on the order of micrometers (μm), e.g., less than 1000 μm. The end face surrounding the first conduit outlet 134 may be (substantially) flat. Depending on its thickness, the end face may be relatively blunt or relatively sharp. The first conduit 108 may be composed of a suitably robust and inert material such as, for example, fused silica (fused quartz).

The second conduit 112 includes a second conduit inlet (or second inlet) 146 (FIG. 1B) for receiving a flow of a suitable inert nebulizing gas (e.g., for nitrogen, argon, helium, etc.) from a nebulizing gas source, and a second conduit outlet (or second outlet) 148 (FIG. 1C) for emitting the nebulizing gas. The second conduit inlet 146 may be located generally at a point upstream of the sprayer tip 116. As illustrated in FIG. 1B, the second conduit inlet 146 may be positioned in (or may be integrally part of) a gas fitting 150 configured for fluidly coupling to another fluid conduit communicating with the nebulizing gas source. The gas flow may enter the gas fitting at an angle (e.g., 90 degrees) to the longitudinal axis 110 along which the second conduit 112 is oriented, as indicated by an arrow. As illustrated in FIG. 1C, the second conduit 112 includes a second conduit outer surface 152 and a second conduit inner surface 154 defining the thickness of the solid portion (wall) of the second conduit 112 that surrounds the inner bore (or lumen) of the second conduit 112. The inner bore of the second conduit 112 may be constant along the length of the second conduit 112, or may vary. In a typical yet non-limiting embodiment, the inside diameter (bore diameter) of the second conduit 112 may be on the order of micrometers (μm), e.g., less than 1000 μm. The second conduit 112 may be composed of a suitably robust material such as, for example, various metals.

As best shown in FIG. 1C, the first conduit 108 and the second conduit 112 define an annular passage (or annular conduit) 158 radially or transversely (i.e., in a direction orthogonal to the longitudinal axis 110) between them, namely between the first conduit outer surface 138 and the second conduit inner surface 154, for conducting the nebulizing gas to the second conduit outlet 148 (which thus also is annular). In the context of the present disclosure, the terms "radially" and "annular" are not meant to limit the first conduit 108 and the second conduit 112 to having circular cross-sections, but instead indicate that the second conduit 112 surrounds at least a portion of the length of the first conduit 108 so as to define or form the annular passage 158. One or more radially oriented, annular spacers 160 may be utilized to radially locate the first conduit 108 in coaxial relation to the second conduit 112. For example, three spacers 160 may be axially spaced from each other along the length of the annular passage 158. The annular spacers 160 have openings (not shown) to allow for substantially unimpeded flow of nebulizing gas through the annular spacers 160. For example, each annular spacer 160 may be configured as a disk with holes, radial slots, or the like, or as a wheel-like arrangement of a central hub and radial spokes, with or without an outer rim. To facilitate assembly, the annular spacers 160 may be pre-positioned on the first conduit outer surface 138 with a tight fit. The first conduit 108 with the annular spacers 160 so mounted thereon may then be inserted into the second conduit 112 such that contact between the annular spacers 160 and the second conduit inner surface 154 is comparatively loose to accommodate axial translation of the first conduit 108 relative to the second conduit 112 as described further herein.

In the embodiment illustrated in FIG. 1C, the first conduit outlet 134 extends axially beyond the second conduit outlet 148. More generally, the respective axial positions (along, or relative to, the longitudinal axis 110) of the first conduit outlet 134 and the second conduit outlet 148 may or may not be the same in a given use of the sample sprayer 100. The adjustable positioning device 120 enables the axial position of the first conduit outlet 134 to be adjustable relative to the axial position of the second conduit outlet 148, as described further herein.

The sprayer tip 116 serves as the distal end of the sample sprayer 100 and as a nozzle, providing the functions of gas-liquid interaction (contact) and sample spray formation. FIG. 1C illustrates one embodiment of the sprayer tip 116. The sprayer tip 116 may include a solid sprayer tip body 168 in which an inner bore 170 is formed. The first conduit 108 and the second conduit 112 are inserted into the inner bore 170 such that the sprayer tip 116 coaxially surrounds the distal end sections of the first conduit 108 and the second conduit 112, including the first conduit outlet 134 and the second conduit outlet 148. An exit orifice 172, from which the liquid and gas are emitted to form the sample spray 104, is formed through the sprayer tip body 168 at a distal-most end face 174 of the sprayer tip 116. The exit orifice 172 may be positioned on-axis as illustrated, or in other embodiments may be offset or at an angle to the longitudinal axis 110. The diameter of the exit orifice 172 may be larger than the diameter of the first conduit outlet 134 to assist in preventing clogging of the exit orifice 172. A portion of the inner bore 170, which may be considered as extending generally from the second conduit outlet 148 to the exit orifice 172, defines a fluid (gas-liquid) interaction region 170A. Thus, the fluid interaction region 170A at one axial end thereof (or inlet end) communicates with the first conduit outlet 134 and the annular passage 158 (at the second conduit outlet 148) to receive the flows of liquid sample and nebulizing gas as depicted by arrows, and at the other axial end thereof communicates with the exit orifice 172, which receives the gas-liquid mixture that evolves into the sample spray 104. Another portion 170B of the inner bore 170 may directly surround the distal end section of the second conduit 112. A transition section 170C may adjoin the portion 170B to the fluid interaction region 170A and provide a tapered or stepped-down reduction in the diameter of the inner bore 170. By this configuration, the transition section 170C may serve as a stop or locating surface against which the second conduit 112 abuts when inserting the second conduit 112 into the inner bore 170.

In some embodiments, the fluid interaction region 170A may have a constant-diameter cylindrical section 178 that transitions to a converging section 180 along which the diameter reduces down to the exit orifice 172. In other embodiments the converging section 180 may not be provided. The end face 174 of the sprayer tip 116 surrounding the exit orifice 172 may be flat or substantially flat, as illustrated. In other embodiments, the exit orifice 172 may include or transition to a diverging section (not shown) that terminates at or is formed in the end face 174.

In some embodiments, the sprayer tip body 168 is composed of a hard, wear-resistant material. In further embodiments, all or part of the sprayer tip body 168 is composed of an optically transparent material that enables the fluid flow in fluid interaction region 170A, and one or more internal components such as first conduit outlet 134, the second conduit outlet 148, and the fluid interaction region 170A, to be visible from outside of the sprayer tip 116.

Generally, the sprayer tip 116 is configured to produce a sample spray 104 by promoting contact between the liquid sample and the nebulizing gas in the fluid interaction region 170A, and emitting the gas and liquid from the exit orifice 172 to form the sample spray 104. In operation, a flow of nebulizing gas is established through the annular passage 158 at an appropriate flow rate and pressure, and exits the annular passage 158 (at second conduit outlet 148 in the present embodiment) and into the fluid interaction region 170A as indicated by arrows. A flow of liquid sample is then established through the first conduit 108 at an appropriate flow rate and pressure, and exits the first conduit outlet 134 and into the fluid interaction region 170A as a liquid sample stream or jet, as indicated by an arrow. The nebulizing gas coaxially envelops the liquid sample stream in the fluid interaction region 170A, such that the liquid flow path merges into the gas flow path, i.e., the liquid flow is injected into the gas flow. The mixture of liquid sample and nebulizing gas then exits the exit orifice 172. The forces exerted by the coaxial gas stream in the fluid interaction region 170A may hydrodynamically compress or focus the liquid stream into a narrower stream, the diameter of which may be smaller than the (minimum) inside diameter of the exit orifice 172. Hence, the liquid may exit the exit orifice 172 as a fine filament of liquid or as elongated drops that form a sample spray 104 immediately after exiting the exit orifice 172. This process results in the formation of the sample spray 104, i.e., an aerosol comprising fine droplets of (or containing) the sample material entrained in the nebulizing gas. Moreover, contact between the sample material and the surface defining the exit orifice 172, and thus clogging of the exit orifice 172, may be minimized or completely avoided.

In some embodiments and depending on operating conditions, liquid sample pulled by the gas flow may initially fragment into coarse droplets, which in turn may further fragment into finer droplets. In some embodiments and depending on operating conditions, at least some droplets may be formed in the exit orifice 172, and/or upstream of the exit orifice 172. In some embodiments and depending on operating conditions, the sample spray 104 may, at least initially, be formed as a "single-file" train of droplets as illustrated in FIG. 1C, and/or may begin to diverge as a conical spray or plume beyond the exit orifice 172 as depicted by dashed lines in FIG. 1C.

In some embodiments the sample sprayer 100 may operate in a manner similar to a gas dynamic virtual nozzle (GDVN). See, e.g., DePonte et al., Gas Dynamic Virtual Nozzle for Generation of Microscopic Droplet Streams, *J. Phys. D: Appl. Phys.* 41 195505 (2008).

Generally, the present disclosure in its broadest aspects does not contemplate any specific limitations on the flow rate of the liquid sample flowing into the sprayer tip 116. In some embodiments the flow rate may be in a range from 10 nL/min to 1 mL/min (0.01 μL/min to 1000 μL/min). In other embodiments the flow rate may be in a range from 1 μL/min to 100 μL/min. The flow rate of the liquid sample, as well as the flow rate of the nebulizing gas, and the respective pressures at which the liquid sample and the nebulizing gas are supplied to the sprayer tip 116, may be optimized as needed for different applications.

Generally, the adjustable positioning device 120 (FIGS. 1A and 1B) is configured to enable a user to adjust or vary the axial position of the first conduit 108, and hence the first conduit outlet 134, relative to the exit orifice 172 of the sprayer tip 116 (as well as relative to other components of the sample sprayer 100 such as the second conduit 112), and thus adjust or vary the axial distance or spacing between the first conduit outlet 134 and the exit orifice 172. The axial adjustment or variance of the first conduit outlet 134 relative to the exit orifice 172 may be realized by enabling the first conduit 108 to be axially movable relative to the sprayer tip body 168 in which the exit orifice 172 is formed and/or by enabling the sprayer tip body 168 to be axially movable relative to the first conduit 108. That is, either the first conduit 108 or the sprayer tip body 168, or both the first conduit 108 and the sprayer tip body 168, may be axially movable relative to other, stationary components of the sample sprayer 100.

The adjustable positioning device 120 may mechanically communicate with (i.e., may be coupled or otherwise mechanically referenced to) the first conduit 108 directly or indirectly via one or more components of the sample sprayer 100. The adjustable positioning device 120 may include a user-operated component, i.e., a component configured to be movable by a user. The adjustable positioning device 120 may be configured such that user-actuated movement of the user-operated component is translated into axial adjustment of the first conduit 108 (and thus the first conduit outlet 134) relative to the exit orifice 172 (i.e., encompassing axial translation of the first conduit 108 relative to the sprayer tip body 168 and/or axial translation of the sprayer tip body 168 relative to the first conduit 108). As one non-limiting example, the user-operated component may include a rotatable member (e.g., a member rotatable about the longitudinal axis 110) that is coupled to the one or more components of the sample sprayer 100 such that rotation of the rotatable member causes axial translation of the first conduit 108.

FIGS. 1A and 1B illustrate one non-limiting example of how axial adjustment of the first conduit 108 may be implemented. As noted above, the first conduit inlet 120 may be fluidly sealed and securely fixed in the bore of a fluidic fitting 136 that fluidly couples the first conduit 108 to another conduit through which the liquid sample flows from an upstream sample source. The fluidic fitting 136 may in turn be fixed to a (first) structural component 114 of the sample sprayer 100 that includes an inner bore 118 along the longitudinal axis 110 through which the first conduit 108 extends. The position of the first conduit 108 is thus fixed relative to the position of the first structural component 114. The second conduit 112 is fixed to a (second) structural component 122 of the sample sprayer 100 that includes an inner bore 124 through which the first conduit 108 and the second conduit 112 extend. The position of the second conduit 112 is thus fixed relative to the position of the second structural component 122. Moreover, as the sprayer tip body 168 is fixed to the second conduit 112, the position of the sprayer tip body 168 (and thus the exit orifice 172) is fixed relative to the position of the second structural component 122. The first structural component 114 and second structural component 122 are coupled to each other and/or to other components of the sample sprayer 100 such that the first structural component 114 is axially movable relative to the second structural component 122, and/or the second structural component 122 is axially movable relative to the first structural component 114. In the illustrated embodiment, a portion 126 of the inner bore 124 of the second structural component 122 is sized to receive an end portion 127 of the first structural component 114 and to provide axial space to accommodate movement of the first structural component 114 and/or the second structural component 122 relative to the other. An appropriate sealing component 128 such as a sealing gland or o-ring may be positioned coaxially between the first structural component 114 and the second structural component 122, such in the space designated 128 in FIG. 1B, to maintain a fluid seal during axial movement.

In the embodiment illustrated in FIGS. 1A and 1B, the first structural component 114 is movably coupled to the second structural component 122. In the specific example, an outer (or inner) thread of the first structural component 114 may be mated with an inner (or outer) thread of the second structural component 122 at a suitable location. FIG. 1B schematically depicts one example and location of a threaded engagement or interface 144 between the first structural component 114 and the second structural component 122. By this threaded engagement 144, the first structural component 114 and the second structural component 122 are in mechanical communication with each other such that rotation of the first structural component 114 and/or the second structural component 122 causes adjustment of the axial positions of the first structural component 114 and the second structural component 122 relative to each other (i.e., axial movement of the first structural component 114 relative to the second structural component 122, and/or axial movement of the second structural component 122 relative to the first structural component 114). Consequently, such rotation causes adjustment of the axial position of the first conduit 108, and hence the first conduit outlet 134, relative to the exit orifice 172 of the sprayer tip body 168. A non-limiting example of a range of adjustable axial translation of the first conduit 108 relative to the exit orifice 172 is depicted in FIG. 1C by a double-headed arrow 186.

In some embodiments and as illustrated in FIGS. 1A and 1B, the first structural component 114 may serve as a user-operated component of the adjustable positioning device 120, i.e., the first structural component 114 may be rotated by the user. To facilitate manipulation by the user, the first structural component 114 may include an adjustment knob 130, which may include flats to facilitate the use of an open wrench or other suitable tool. In some embodiments and as illustrated, a locking mechanism 156 may be provided to enable the axial position of the first conduit 108 to be locked once a desired axial position of the first conduit outlet 134 relative to the exit orifice 172 has been obtained. The locking mechanism 156 may include, for example, a set screw threaded for movement in a direction that results in the second structural component 122 moving into a fixed-contact engagement with the first structural component 114 (e.g., by a clamping action).

The axial adjustability of the first conduit 108 may provide one or more advantages. In particular, the properties or attributes of the sample spray 104 (e.g., droplet size, flow rate, angle of divergence, etc.) that are considered optimal may vary from one application to another. Such properties or attributes depend on the operating parameters of the sample sprayer 100, including the fluid mechanics-related conditions in the fluid interaction region 170A of the sprayer tip 116 such as the flow rates of the liquid sample and the nebulizing gas and the gas back pressure at or across the exit orifice 172. The fluid mechanics in the fluid interaction region 170A are influenced by the presence of the first conduit 108 in the fluid interaction region 170A. In particular, the gas back pressure across the exit orifice 172 varies with the position of the first conduit 108 (and thus with the position of the first conduit outlet 134). That is, the gas back pressure across the exit orifice 172 varies with the axial distance between the first conduit 108 (and thus the first conduit outlet 134) and the exit orifice 172. For example, moving the first conduit 108 closer to the exit orifice 172 will increase the pressure. In embodiments disclosed herein, the adjustable positioning device 120 allows the sample spray 104 to be adjusted or "tuned" and thus to be optimized for a given application. Moreover, the adjustable positioning device 120 allows adjustment of the first conduit 108 during actual operation of the sample sprayer 100, i.e., while the sample spray 104 is being generated, which significantly facilitates the process of adjusting and optimizing the sample spray 104. Hence, making adjustments does not require that the sample spray 104 be stopped but instead can be done "on-the-fly."

The on-the-fly adjustability is further useful in situations where the optimal operating parameters of the sample sprayer 100 during a start-up or initiation phase of the sample spray 104 are not the same as the optimal operating parameters during a normal or steady-state operational phase of the sample spray 104. For example, the flow rates required for initiating a stable sample spray 104 may be different than the rates required for subsequently maintaining the stability of the stable sample spray 104 after start-up, and the optimal position of the first conduit 108 may be different for the different flow rates utilized during the start-up and normal-run phases. In this case, the first conduit 108 may be adjusted or preset to a first position that is optimal for initiating a stable sample spray 104, and then adjusted to a second position that is optimal for maintaining a stable sample spray 104 during a normal operation of the sample sprayer 100.

As noted above, the gas back pressure across the exit orifice 172 varies with the position of the first conduit tip 142. Thus, the gas back pressure may be utilized to evaluate and precisely position the first conduit tip 142. The gas back pressure may be measured by a pressure gauge fluidly communicating with (e.g., tapped into) the second conduit 112. For example, the pressure gauge may be mounted to the gas fitting 150 so as to operatively communicate with the gas flowing through the gas fitting 150. As also noted above, all or part of the sprayer tip body 168 may be composed of an optically transparent material that allows a user to view the first conduit tip 142 and the fluid flow in the fluid interaction region 170A, which may further facilitate the adjustment process.

Figure 2A:
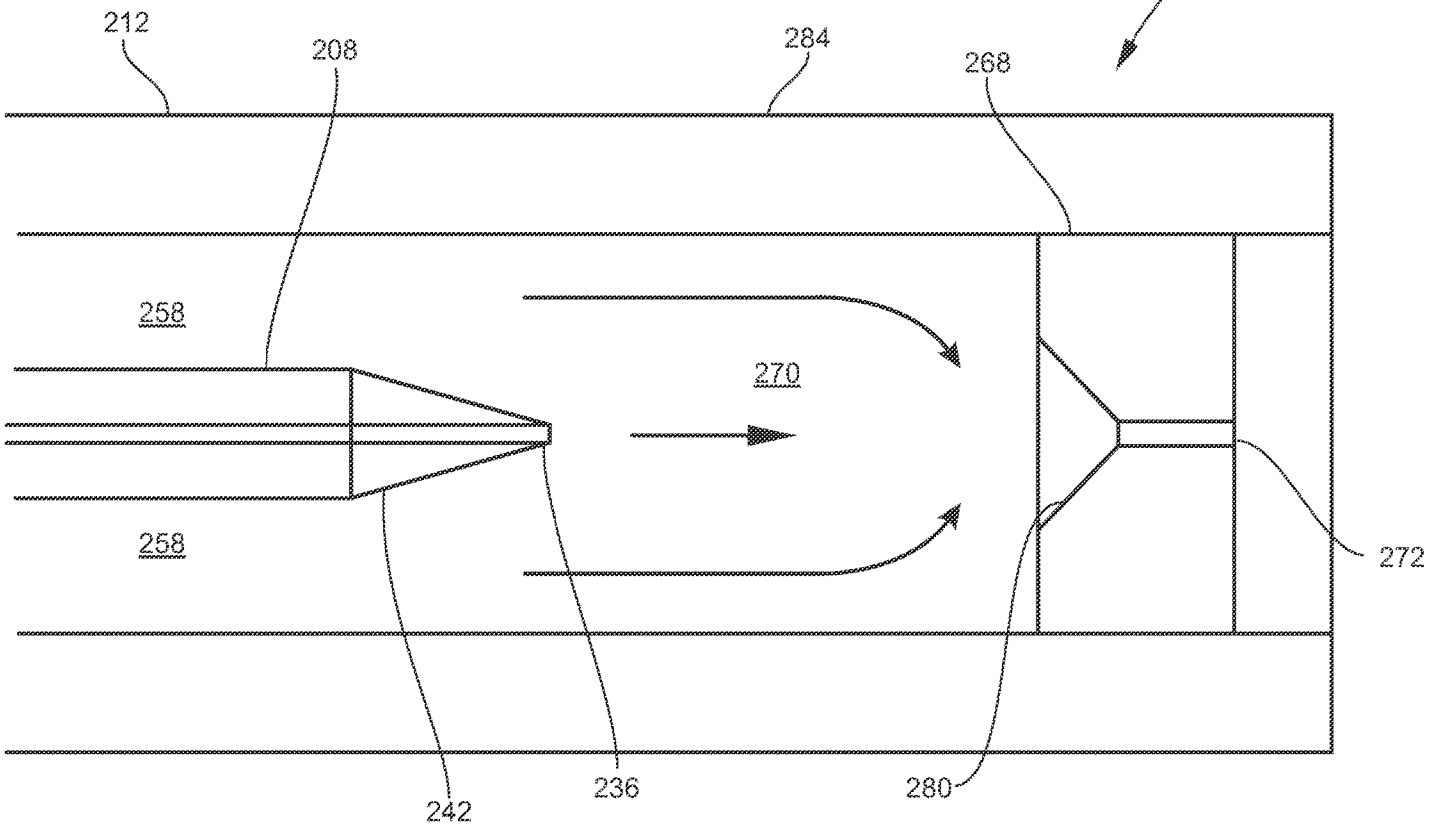
FIG. 2A is a schematic cross-sectional side view (lengthwise) of a sprayer tip according to another embodiment.

FIG. 2A is a schematic cross-sectional side view (lengthwise) of a sprayer tip 216 according to another embodiment. The sprayer tip 216 may be provided as part of a sample sprayer such as described above and illustrated in FIGS. 1A-1C. Hence, the sample sprayer may include a first conduit 208 with a first conduit tip 242 terminating at a first conduit outlet 234 from which the liquid sample is emitted, a second conduit 212 surrounding the first conduit 208, and an annular passage 258 defined between the first conduit 208 and the second conduit 212 for conducting the gas. Also as in the embodiment described above and illustrated in FIGS. 1A-1C, the sprayer tip 216 may include a sprayer tip body 268 and a fluid interaction region 270. The sprayer tip body 268 may include an exit orifice 272 disposed at an axial distance from the first conduit outlet 234 relative to the longitudinal axis. The fluid interaction region 270 is disposed along the longitudinal axis between the first conduit 208 and the exit orifice 272, and communicates with first conduit outlet 234, the annular passage 258, and the exit orifice 272. Moreover, the sprayer tip 216 is configured to produce a sample spray by contact between the liquid sample and the gas in the fluid interaction region 270 and emit the sample spray from the exit orifice 272. Further, the sample sprayer associated with the sprayer tip 216 may include an adjustable positioning device (e.g., the positioning device 120 described above and illustrated in FIGS. 1A-1C) mechanically communicating with the first conduit 208 and configured to translate the first conduit 208 along the longitudinal axis in response to adjustment of the positioning device, wherein an axial position of the first conduit outlet 234 along the longitudinal axis is adjustable relative to the exit orifice 272.

A structural portion 284 of the sprayer tip 216 illustrated in FIG. 2A surrounds or defines the fluid interaction region 270 that is downstream from the first conduit outlet 234. In comparison to the embodiment described above and illustrated in FIG. 1C, this structural portion 284 of the sprayer tip 216 may be considered as being an integral part of, or an extension of, the second conduit 212. Stated in an alternative way, the structural portion 284 may be considered as being the distal section of the second conduit 212, such that the second conduit 212 (at its distal section) may be considered as surrounding or defining the fluid interaction region 270. In still other words, the distal section of the second conduit 212 (corresponding to the structural portion 284) may be considered as being a component of the sprayer tip 216. Moreover, the structural portion 284 of the sprayer tip 216 illustrated in FIG. 2A surrounds the sprayer tip body 268. Hence, when the structural portion 284 is considered as being integral with the second conduit 212, the sprayer tip body 268 may be considered as being inside the second conduit 212. As one non-limiting example, the sprayer tip 216 may be assembled by inserting the sprayer tip body 268 into the second conduit 212 (e.g., from the open distal end of the second conduit 212) and securing the sprayer tip body 268 at a desired axial position. The sprayer tip body 268 may be secured, for example, by press-fitting or by an appropriate bonding or attaching technique. By comparison, the embodiment described above and illustrated in FIG. 1C, at least a portion of the sprayer tip body 168 (i.e., the part of the sprayer tip 116 in which the exit orifice 172 is located) surrounds the fluid interaction region 170A.

As also illustrated in FIG. 2A, in some embodiments the sprayer tip 216 may include a converging section 280 disposed between the fluid interaction region 270 and the exit orifice 272. The converging section 280 converges in the direction along the longitudinal axis toward the exit orifice 272, i.e., has a diameter that reduces down to the diameter of the exit orifice 272 in the direction toward the exit orifice 272. In the illustrated embodiment, the converging section 280 is formed in the sprayer tip body 268, while in other embodiments may be formed or defined by the inside surface(s) enclosing the fluid interaction region 270.

Figure 2B:
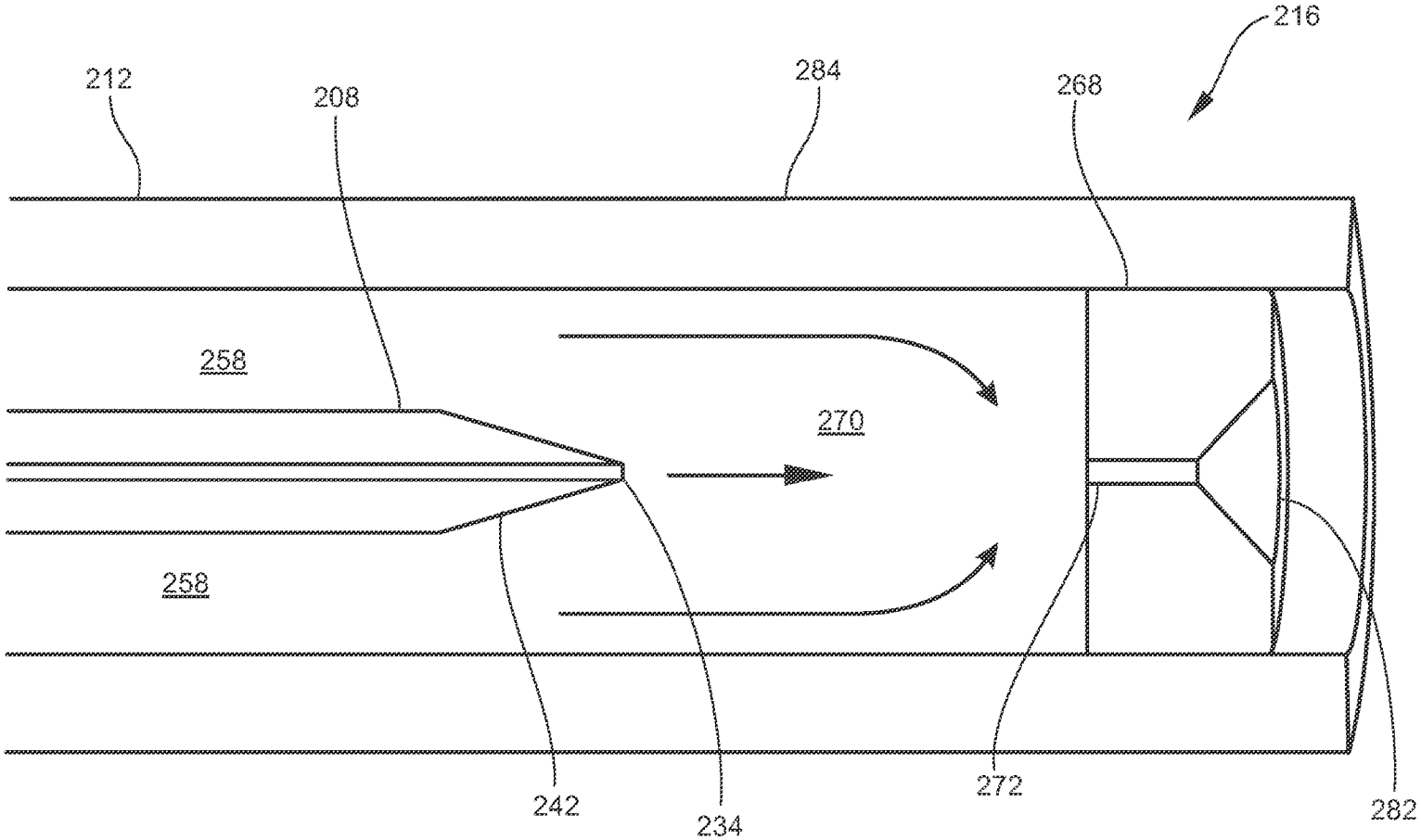
FIG. 2B is a schematic cross-sectional side view (lengthwise) of a sprayer tip according to another embodiment.

FIG. 2B is a schematic cross-sectional side view (lengthwise) of the sprayer tip 216 according to another embodiment. In comparison to the embodiment shown in FIG. 2A, in FIG. 2B the sprayer tip 216 includes a diverging section 282 positioned to receive the sample spray emitted from the exit orifice 272. The diverging section 282 diverges in a direction away from the exit orifice 272 i.e., has a diameter that increases up from the diameter of the exit orifice 272 in the direction away from the exit orifice 272. In the illustrated embodiment, the diverging section 282 is formed in the sprayer tip body 268.

In a further embodiment, the sprayer tip 216 may include both a converging section 280 and a diverging section 282, respectively disposed on the opposite sides of the exit orifice 272.

A sample sprayer that includes the sprayer tip 216 as illustrated in FIG. 2A or 2B may operate to generate a sample spray in generally the same manner as described above in conjunction with FIGS. 1A-1C, and may provide the same advantage(s) as described above.

Generally, the sample sprayer 100 according to any of the embodiments described herein may be utilized in any application entailing the use of sample material in an aerosolized form. For example, the sample sprayer 100 may be utilized as part of a sample analysis system to introduce a sample spray 104 into an analytical instrument. In a more specific example, the sample spray 104 generated by the sample sprayer 100 may be utilized to produce analyte ions from the sample material of the sample spray 104. The sample sprayer 100 may be adapted to produce a particular type of spray useful for a particular type of spray-based ionization, such as thermospray ionization, electrospray ionization, triboelectric spray ionization, sonic spray ionization or ultrasonication-assisted spray ionization. Additionally, the sample spray 104 may be utilized to create one or more samples (e.g., spots) on a solid substrate, which may thereafter be analyzed by an optical technique or ionized such as by laser desorption or a technique related to ambient ionization.

Figure 3:
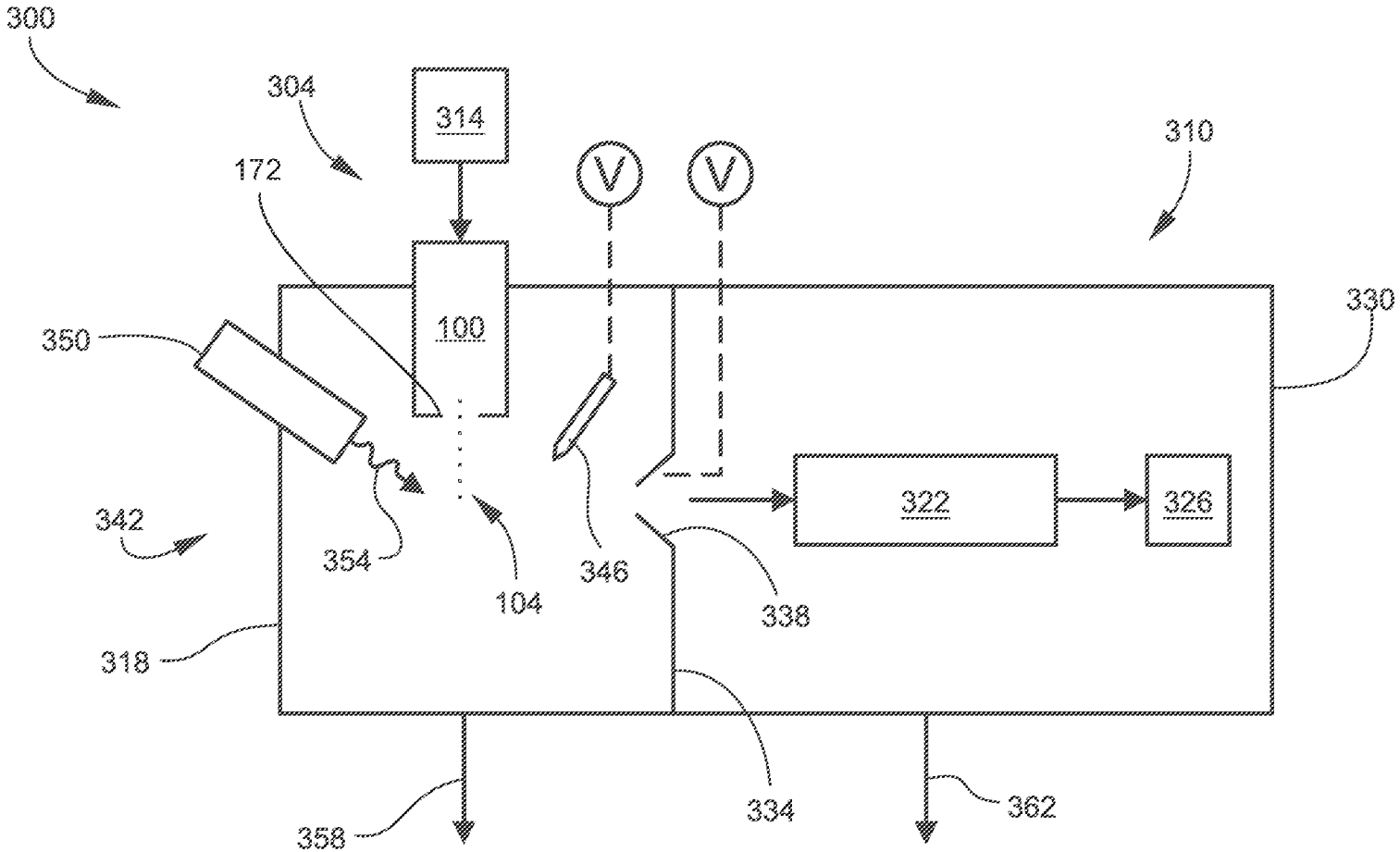
FIG. 3 is a schematic view of an example of a sample analysis system according to some embodiments.

FIG. 3 is a schematic view of an example of a sample analysis system 300 according to some embodiments. The sample analysis system 300 may generally include a sample introduction device or system 304 and an analytical instrument 310. The sample introduction device 304 may generally include the sample sprayer 100 as described herein and a sample source 314 for supplying the liquid sample to the sample sprayer 100. The sample sprayer 100 may communicate with a chamber 318 into which the sample sprayer 100 emits an analyte-containing sample spray 104. Depending on the embodiment, the chamber 318 may be considered as a part of the analytical instrument 310, or as an interface (such as, for example, an atmospheric pressure interface) between the sample introduction device 304 and the analytical instrument 310.

The analytical instrument 310 may generally include an analyzing device 322 and a detector 326, the configuration and operation of which depend on the type of analytical instrument 310 being implemented. Generally, the analyzing device 322 and detector 326 are configured to measure an attribute of (i.e., acquire data from) analytes contained in the sample spray 104, or atoms, ions, or photons produced from the analytes. In some embodiments, the analyzing device 322 and detector 326 are located in a housing 330 separated from the chamber 318 by a boundary 334 such as a wall. A sampling interface 338 positioned at or formed through the boundary 334 may define a path for analytes, or ions or photons produced from the analytes (depending on the embodiment), to be transported to the analyzing device 322. In some embodiments, a pressure differential exists between the respective interiors of the chamber 318 and the housing 330. In some embodiments, the interior of the housing 330 is maintained at a vacuum level while the interior of the chamber 318 is maintained at (or around) atmospheric pressure. In some embodiments, the housing 330 includes multiple chambers maintained at different pressures, such as successively reduced pressures in embodiments in which the analyzing device 322 must be operated at a high vacuum level (very low pressure).

In some embodiments and as illustrated, the sample analysis system 300 includes an atmospheric pressure ionization (API) source 342. The API source 342 includes an ionization device configured for producing analyte ions from the analytes contained in the sample spray 104 emitted from the sample sprayer 100. The type of ionization device depends on the type of API source 342 provided. Examples of API sources 342, include, but are not limited to, spray ionization sources (e.g., electrospray ionization (ESI) sources), atmospheric pressure chemical ionization (APCI) sources, atmospheric pressure photoionization (APPI) sources, and inductively coupled plasma (ICP) sources and other plasma-based sources. Ions produced in the API source 342 or photons emitted from atoms produced in the API source 342 are directed into the housing 330 via the sampling interface 338. In some embodiments, a flow of an inert drying gas (e.g., nitrogen, argon, etc.) may be directed into the chamber 318, such as coaxially around the sampling interface 338 or as a curtain in front of the sampling interface 338, to assist in preventing neutral molecules from passing through the sampling interface 338.

In some embodiments, the ionization device may include an electrode 346 communicating with a voltage source. In a case where the API source 342 is configured as an ESI source, the electrode 346 may be positioned to operate in conjunction with an appropriately positioned counter-electrode to produce an electric field having a spatial orientation effective for producing an electrospray from the sample spray 104. Analyte ions are consequently produced from the electrospray according to known mechanisms. The electrode 346 may be positioned at a distance from the sample sprayer 100 or may be in contact with an electrically conductive portion of the sample sprayer 100. The sample sprayer 100 may generate electrically neutral (non-charged) sample spray 104 in the manner described herein separately and independently of the subsequent generation of electrospray from the sample spray 104. The sampling interface 338 (ion inlet), for example, may serve as the counter-electrode.

In other embodiments in which the API source 342 is configured as an APCI source, the electrode 346 may be configured and positioned to generate a corona discharge (i.e., a corona discharge needle) to which the sample spray 104 is exposed, as appreciated by persons skilled in the art. The nebulizing gas emitted from the sample sprayer 100 may be utilized to form primary ions, or a separate input of a reagent gas (not shown) may be provided for this purpose.

In other embodiments, the ionization device may include a plasma source 350. In the case of APPI, photons 354 generated in the plasma irradiate the sample spray 104 to form ions. The photons 354 may propagate through a window of the plasma source 350, or the plasma source 350 may have a windowless configuration as appreciated by persons skilled in the art. The plasma may be generated and sustained by various known techniques. The plasma-forming gas may be a single gas species or a combination or two or more different species. Various types of plasmas, and the design and operating principles of various types of energy sources utilized to generate plasmas, are generally known to persons skilled in the art and thus for purposes of the present disclosure need not be described further.

In other embodiments entailing APPI, a non-plasma based photon source may be utilized instead of the plasma source 350. For example, the photons 354 may be directed as a coherent beam generated by a laser.

In other embodiments entailing plasma-based ionization, the charged species of the plasma (plasma electrons and/or plasma ions) may interact with the sample spray 104 to form ions. The plasma source 350 may, for example, be an inductively coupled plasma (ICP) source. In such embodiments, the plasma source 350 may be configured as a plasma torch having a concentric tube configuration, with a sample inlet communicating with the exit orifice 172 of the sample sprayer 100 (not specifically shown). The sample spray 104 emitted from the sample sprayer 100 may flow through a central tube of the plasma torch, while a plasma-forming gas flows through an annular conduit coaxial with the flow of sample spray 104 and is energized into a plasma. The sample spray 104 is then injected into the plasma, and the resulting analytes ions and gases are discharged from an outlet of the plasma torch into the chamber 318.

In embodiments in which analyte ions are measured (e.g., the API source 342 is configured as an ESI, APCI, APPI, or plasma-based source, etc.), the analyte ions produced in the API source 342 are directed (under the influence of gas flow, a pressure differential, and/or voltage gradient) into the housing 330 via the sampling interface 338. The sampling interface 338 may include ion optics configured for extracting the analyte ions and transmitting them as a focused beam to the analyzing device 322. Ion optics may include, for example, a skimmer plate as schematically illustrated, a capillary tube, an ion lens, etc. An exhaust port 358 may remove neutral gases from the chamber 318. One or more vacuum ports 362 may remove gases from the housing 330 to maintain the required levels of vacuum in the analyzing section. Additionally, a flow of an inert drying gas (e.g., argon, nitrogen, etc.) may be established (not shown) near the sampling interface 338 to assist in reducing the amount of neutral gas molecules passing into the analyzing section.

In some embodiments in which analyte ions are measured, the analytical instrument 310 may be a mass spectrometer (MS). As appreciated by persons skilled in the art, an MS is configured for receiving analyte ions, spectrally resolving the analyte ions on the basis of their respective mass-to-charge (m/z) ratios, and measuring the ion abundance (counting the ions) of each m/z ratio detected. In such embodiments, the analyzing device 322 is a mass analyzer. The structure and operation of various types of mass analyzers are known to persons skilled in the art. Examples of mass analyzers include, but are not limited to, multipole electrode structures (e.g., quadrupole mass filters, linear ion traps, three-dimensional Paul traps, etc.), time-of-flight (TOF) analyzers, electrostatic traps (e.g. Kingdon, Knight and ORBITRAP® traps) and ion cyclotron resonance (ICR) traps (FT-ICR or FTMS, also known as Penning traps). The detector 326 may be any device configured for collecting and measuring the flux (or current) of mass-discriminated ions outputted from the analyzing device 322. Examples of ion detectors include, but are not limited to, image current detectors, electron multipliers, photomultipliers, Faraday cups, and micro-channel plate (MCP) detectors.

In other embodiments in which analyte ions are measured, the analytical instrument 310 may be an ion mobility spectrometer (IMS). As appreciated by persons skilled in the art, an IMS is configured for receiving analyte ions, spectrally resolving the analyte ions on the basis of their respective ion mobilities (e.g., drift time), and measuring the ion abundance as a function of ion mobility. In such embodiments, the analyzing device 322 may be a drift cell, which may be configured for operation at (or around) atmospheric pressure or at vacuum. Ions drift through the drift cell in the presence of an inert buffer gas (e.g., argon, nitrogen, etc.) under the influence of a voltage gradient established along the axial length of the drift cell. The time required for an ion to traverse the length of the drift cell is a measurement of its ion mobility, and is primarily dependent on its collisional cross-section (CCS). In still other embodiments, the analytical instrument 310 may have a hyphenated configuration such as, for example, an IM-MS instrument in which an IM drift cell is followed by a mass analyzer.

In other embodiments in which the API source 342 is configured for plasma-based ionization (e.g., utilizing a plasma torch as the plasma source 350), the photons emitted from analyte atoms produced in the plasma are measured, instead of analyte ions. In such embodiments, the analytical instrument 310 may be an optical emission spectrometer (OES), also referred to as an atomic emission spectrometer (AES). As appreciated by persons skilled in the art, an OES is configured for receiving photons emitted from the sample atoms as they relax from their excited states (induced by the plasma), spectrally resolving the photons on the basis of their respective wavelengths, and measuring the light intensity (abundance) at each wavelength. In the case of OES, the sampling interface 338 may include photon optics (e.g., windows, lenses, mirrors, etc.) for collecting the light emitted from the sample atoms and transmitting the light as a focused beam to the analyzing device 322. The analyzing device 322 may be, for example, a diffraction grating or other device configured for spectrally resolving the different wavelengths of the ensemble of photons comprising the light beam. The detector 326 may be any suitable optical detector such as, for example, one or more photomultiplier tubes (PMTs), photodiodes, charge-coupled devices (CCDs), etc.

An analyte-containing sample spray 104 generated as described above may be useful in other types of analytical instruments. Thus, in some embodiments the analytical instrument 310 of the sample analysis system 300 may be or include an ultraviolet (UV), visible (Vis), infrared (IR), or Fourier transform infrared (FTIR) spectroscopy instrument, or an instrument that measures light absorbance, light transmission, light scattering, Raman scattering, fluorescence, luminescence, etc., or a microscope or other imaging device. A reagent serving as a labeling agent may be added to the analytes, for example in the context of flash or glow luminescence or fluorescence.

Moreover, the sample spray 104 may be utilized to prepare other types of sample formats. For example, the sample spray 104 may be dispensed into a container or the well of a microplate. In another example, the analytical instrument 310 may be or include an optical plate reader. As another example, the sample spray 104 may be applied as a coating to a substrate, or through a mask to produce a pattern on a substrate, or applied so as to create sample spots on a substrate.

It will also be understood that the sample analysis system 300 may further include a system controller (not shown) that controls and coordinates the various operations of the components of the sample analysis system 300. The system controller may include one or more types of hardware, firmware and/or software, as well as one or more memories and databases, as needed for these purposes.

Figure 4:
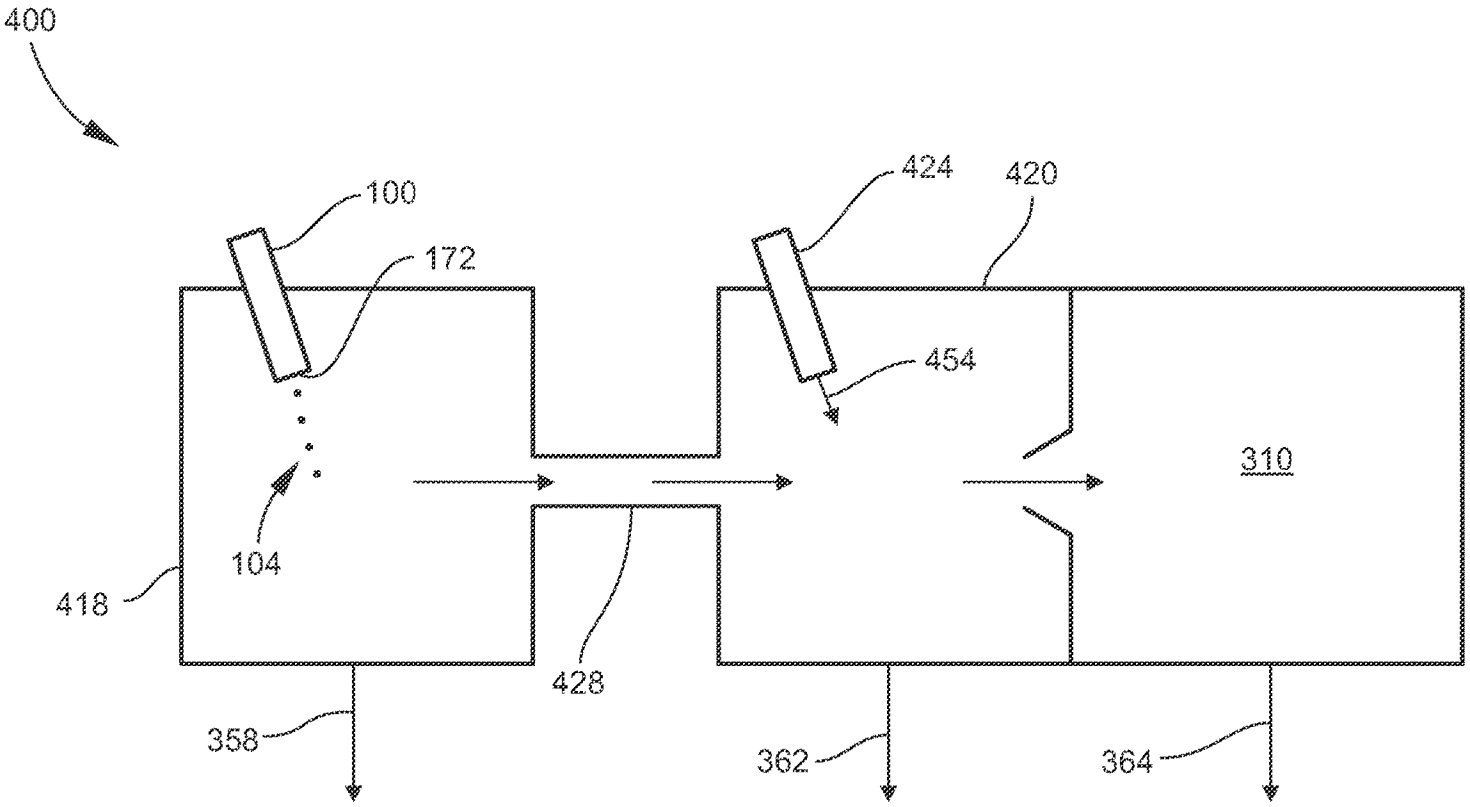
FIG. 4 is a schematic view of an example of a sample analysis system according to other embodiments.

FIG. 4 is a schematic view of an example of a sample analysis system 400 according to other embodiments. The sample analysis system 400 may generally include many of the same components or features of the sample analysis system 300 described above and illustrated in FIG. 3. Thus, for example, the sample analysis system 400 may include a sample sprayer 100 and an analytical instrument 310 as described herein. In the present embodiment, however, the sample analysis system 400 is configured for ionizing the sample spray 104 by an ionization technique of the type that is implemented in the vacuum regime. Examples of vacuum ionization techniques include, but are not limited to, electron ionization (EI), chemical ionization (CI), photoionization (PI), and laser desorption ionization (LDI). In the present embodiment, the sample analysis system 300 includes an atmospheric pressure interface, in particular a (first) chamber (or sample introduction chamber) 418 maintained at atmospheric pressure. The sample sprayer 100 emits the sample spray 104 into the first chamber 418. The sample analysis system 400 also includes a (second) chamber (or ionization chamber) 420 maintained at a vacuum level appropriate for the ionization technique being implemented. An ionization device 424 is appropriately positioned to provide energy 454 in the second chamber 420 for ionizing interaction with the sample material supplied by the sample spray 104.

In the illustrated embodiment, the first chamber 418 and the second chamber 420 are physically separate. A transfer line 428 provides fluid communication between the first chamber 418 and the second chamber 420, and thus provides a path for the sample spray 104 or least the sample material of the sample spray 104 to travel from the first chamber 418 to the second chamber 420. The transfer line 428 may be a small-bore tube or capillary exhibiting low gas conductance. By this configuration, the transfer line 428 allows the first chamber 418 and the second chamber 420 to be essentially fluidly isolated from each other, thereby preserving the vacuum in the second chamber 420, while allowing the sample material to be transferred from the first chamber 418 to the second chamber 420. The transfer line 428 may be heated to promote evaporation of solvent in the sample spray 104. Transport of the sample material into the second chamber 420 may be primarily driven by the pressure differential between the first chamber 418 and the second chamber 420. Desired pressure/vacuum levels in the sample analysis system 400 may maintained by a vacuum system communicating with the exhaust port 358 and one or more vacuum ports 362 and 364.

In another embodiment of a sample analysis system, the sample analysis system does not include an atmospheric pressure interface. Instead, the sample sprayer 100 emits the sample spray 104 directly into a vacuum chamber, which may be the same chamber in which an ionization device operates.

It will be understood that FIGS. 3 and 4 are high-level schematic depictions of the systems, devices, and features described above. As appreciated by persons skilled in the art, other components such as additional structures, devices, fluidics and electronics may be included as needed for practical implementations, depending on a given application.

EXEMPLARY EMBODIMENTS

Exemplary embodiments provided in accordance with the presently disclosed subject matter include, but are not limited to, the following:

1. A sample sprayer, comprising: a first conduit disposed along a longitudinal axis, the first conduit comprising a first inlet for receiving a flow of a liquid sample, a first outlet for emitting the liquid sample, and a first conduit outer surface; a second conduit surrounding the first conduit about the longitudinal axis, the second conduit comprising a second inlet for receiving a flow of a gas and a second conduit inner surface spaced from the first conduit outer surface, wherein the first conduit and the second conduit define an annular passage for conducting the gas; a sprayer tip comprising a sprayer tip body and a fluid interaction region, wherein: the sprayer tip body comprises an orifice disposed at an axial distance from the first outlet relative to the longitudinal axis; the fluid interaction region is disposed along the longitudinal axis between the first conduit and the orifice, and communicates with the first outlet, the annular passage, and the orifice; and the sprayer tip is configured to produce a sample spray by contact between the liquid sample and the gas in the fluid interaction region and emit the sample spray from the orifice; and an adjustable positioning device mechanically communicating with the first conduit and configured to translate the first conduit along the longitudinal axis in response to adjustment of the positioning device, wherein an axial position of the first outlet along the longitudinal axis is adjustable relative to the orifice.

2. The sample sprayer of embodiment 1, wherein the second conduit comprises a second outlet for emitting the gas from the annular passage into the fluid interaction region.

3. The sample sprayer of embodiment 2, wherein the first conduit extends through the second conduit into the fluid interaction region.

4. The sample sprayer of any of embodiments 1-3, wherein the sprayer tip body surrounds the fluid interaction region.

5. The sample sprayer of any of embodiments 1-4, wherein at least a portion of the sprayer tip body surrounds the second conduit.

6. The sample sprayer of embodiment 1, wherein the second conduit surrounds the fluid interaction region.

7. The sample sprayer of embodiment 1 or 6, wherein the second conduit surrounds the sprayer tip body.

8. The sample sprayer of any of embodiments 1-7, comprising a converging section disposed between the fluid interaction region and the orifice, wherein the converging section converges in a direction toward the orifice.

9. The sample sprayer of embodiment 8, wherein the converging section is part of the sprayer tip body.

10. The sample sprayer of any of embodiments 1-9, comprising a diverging section positioned to receive the sample spray emitted from the orifice, wherein the diverging section diverges in a direction away from the orifice.

11. The sample sprayer of embodiment 10, wherein the diverging section is part of the sprayer tip body.

12. The sample sprayer of any of embodiments 1-11, wherein at least a portion of the sprayer tip body is composed of a transparent material or sapphire.

13. The sample sprayer of any of embodiments 1-12, wherein the first conduit comprises a conical first conduit tip terminating at the first outlet.

14. The sample sprayer of any of embodiments 1-13, wherein the first outlet and the orifice have microscale diameters.

15. The sample sprayer of any of embodiments 1-14, wherein the adjustable positioning device comprises a rotatable member mechanically communicating with the first conduit such that rotation of the rotatable member causes translation of the first conduit.

16. An atmospheric pressure ionization (API) source, comprising: a sample sprayer according to any of embodiments 1-15; an ionization chamber communicating with the second conduit outlet; and an ionization device configured for ionizing analytes from the sample spray emitted from the second outlet into the ionization chamber at atmospheric pressure.

17. The API source of embodiment 16, wherein the ionization device is selected from the group consisting of: an electrode configured for generating electrospray from the sample spray; an electrode configured for generating a corona discharge effective for atmospheric-pressure chemical ionization; a photon source configured for generating photons for interaction with the sample spray; a plasma source configured for generating plasma for interaction with the sample spray; a plasma torch communicating with the second outlet and configured for generating plasma for interaction with droplets from the sample spray; and a combination of two or more of the foregoing.

18. A sample analysis system, comprising: an API source according to embodiment 16 or 17; and an analytical instrument interfaced with the ionization chamber and configured for measuring an attribute of analyte ions or analyte photons produced by the API source.

19. The sample analysis system of embodiment 18, wherein the analytical instrument is selected from the group consisting of: a mass spectrometer; an ion mobility spectrometer; an optical emission spectrometer; and a combination of two or more of the foregoing.

20. A method for producing a sample spray, the method comprising: flowing a liquid sample through a first conduit, through a first outlet of the first conduit, and into a fluid interaction region of a sprayer tip; flowing a gas through an annular passage between the first conduit and a second conduit surrounding the first conduit and into the fluid interaction region, wherein the gas contacts the liquid sample and produces a sample spray; emitting the sample spray from an orifice of the sprayer tip, wherein the fluid interaction region is disposed along a longitudinal axis and the first outlet is positioned at an axial position along the longitudinal axis relative to the orifice; while emitting the sample spray, translating the first conduit to adjust the axial position of the first outlet relative to the orifice.

21. The method of embodiment 20, wherein translating comprises moving an adjustment member coupled to the first conduit.

22. The method of embodiment 20 or 21, comprising determining the axial position of the first outlet relative to the orifice by measuring a pressure at the orifice.

23. A method for producing analyte ions, the method comprising: producing a sample spray according to the method of any of embodiments 20-22; and ionizing analytes contained in droplets of the sample spray.

24. The method of embodiment 23, comprising emitting the sample spray into an ionization chamber, wherein ionizing is done in the ionization chamber.

25. The method of embodiment 23 or 24, wherein ionizing comprises performing a technique selected from the group consisting of: atmospheric-pressure ionization (API); electrospray ionization (ESI); atmospheric-pressure chemical ionization (APCI); atmospheric pressure photoionization (APPI); and plasma-based ionization.

26. A method for analyzing a sample, the method comprising: ionizing analytes according to the method of any of embodiments 23-25; and measuring an attribute of the ions.

27. The method of embodiment 26, wherein measuring comprises measuring mass-to-charge ratio, ion mobility, or both mass-to-charge ratio and ion mobility.

28. A method for atomizing a sample, the method comprising: producing a sample spray according to the method of claim 18; generating plasma; and emitting the droplets from the sample spray into the plasma.

29. A method for analyzing a sample, the method comprising: atomizing the sample according to the method of any of embodiments 20-22 to produce sample atoms; and measuring an attribute of the sample atoms or photons emitted from the sample atoms.

30. The method of embodiment 29, wherein measuring comprises spectrally resolving photons emitted from the atoms according to wavelength.

All references cited herein are incorporated by reference in their entireties.

It will be understood that terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A sample sprayer, comprising:

a first conduit disposed along a longitudinal axis, the first conduit comprising a first inlet for receiving a flow of a liquid sample, a first outlet for emitting the liquid sample, and a first conduit outer surface;

a second conduit surrounding the first conduit about the longitudinal axis, the second conduit comprising a second inlet for receiving a flow of a gas and a second conduit inner surface spaced from the first conduit outer surface, wherein the first conduit and the second conduit define an annular passage for conducting the gas;

a sprayer tip comprising a sprayer tip body and a fluid interaction region, wherein:

the sprayer tip body comprises an orifice disposed at an axial distance from the first outlet relative to the longitudinal axis;

the fluid interaction region is disposed along the longitudinal axis between the first conduit and the orifice, and communicates with the first outlet, the annular passage, and the orifice; and the sprayer tip is configured to produce a sample spray by contact between the liquid sample and the gas in the fluid interaction region and emit the sample spray from the orifice; and an adjustable positioning device mechanically communicating with the first conduit and configured to translate the first conduit along the longitudinal axis in response to adjustment of the positioning device, wherein an axial position of the first outlet along the longitudinal axis is adjustable relative to the orifice.

2. The sample sprayer of claim 1, wherein the second conduit comprises a second outlet for emitting the gas from the annular passage into the fluid interaction region.

3. The sample sprayer of claim 2, wherein the first conduit extends through the second conduit into the fluid interaction region.

4. The sample sprayer of claim 1, wherein the sprayer tip body has a configuration selected from the group consisting of:

at least a portion of the sprayer tip body surrounds the fluid interaction region;

at least a portion of the sprayer tip body surrounds the second conduit; and both of the foregoing.

5. The sample sprayer of claim 1, wherein the second conduit has a configuration selected from the group consisting of:

at least a portion of the second conduit surrounds the fluid interaction region;

at least a portion of the second conduit surrounds the sprayer tip body; and both of the foregoing.

6. The sample sprayer of claim 1, comprising a converging section disposed between the fluid interaction region and the orifice, wherein the converging section converges in a direction toward the orifice.

7. The sample sprayer of claim 1, comprising a diverging section positioned to receive the sample spray emitted from the orifice, wherein the diverging section diverges in a direction away from the orifice.

8. The sample sprayer of claim 1, wherein at least a portion of the sprayer tip body is composed of a transparent material or sapphire.

9. The sample sprayer of claim 1, wherein the first conduit comprises a conical first conduit tip terminating at the first outlet.

10. The sample sprayer of claim 1, wherein the adjustable positioning device comprises a rotatable member mechanically communicating with the first conduit such that rotation of the rotatable member causes translation of the first conduit.

11. An atmospheric pressure ionization (API) source, comprising:

a sample sprayer according to claim 1;

an ionization chamber communicating with the second conduit outlet; and an ionization device configured for ionizing analytes from the sample spray emitted from the second outlet into the ionization chamber at atmospheric pressure.

12. The API source of claim 11, wherein the ionization device is selected from the group consisting of:

an electrode configured for generating electrospray from the sample spray;

an electrode configured for generating a corona discharge effective for atmospheric-pressure chemical ionization;

a photon source configured for generating photons for interaction with the sample spray;

a plasma source configured for generating plasma for interaction with the sample spray;

a plasma torch communicating with the second outlet and configured for generating plasma for interaction with droplets from the sample spray; and a combination of two or more of the foregoing.

13. A sample analysis system, comprising:

an API source according to claim 11; and an analytical instrument interfaced with the ionization chamber and configured for measuring an attribute of analyte ions or analyte photons produced by the API source.

14. A method for producing a sample spray, the method comprising:

flowing a liquid sample through a first conduit, through a first outlet of the first conduit, and into a fluid interaction region of a sprayer tip;

flowing a gas through an annular passage between the first conduit and a second conduit surrounding the first conduit and into the fluid interaction region, wherein the gas contacts the liquid sample and produces a sample spray;

emitting the sample spray from an orifice of the sprayer tip, wherein the fluid interaction region is disposed along a longitudinal axis and the first outlet is positioned at an axial position along the longitudinal axis relative to the orifice;

while emitting the sample spray, translating the first conduit to adjust the axial position of the first outlet relative to the orifice.

15. The method of claim 14, wherein translating comprises moving an adjustment member coupled to the first conduit.

16. The method of claim 14, comprising determining the axial position of the first outlet relative to the orifice by measuring a pressure at the orifice.

17. A method for producing analyte ions, the method comprising:

producing a sample spray according to the method of claim 14; and ionizing analytes contained in droplets of the sample spray.

18. A method for analyzing a sample, the method comprising:

ionizing analytes according to the method of claim 17; and measuring an attribute of the ions.

19. A method for atomizing a sample, the method comprising:

producing a sample spray according to the method of claim 14;

generating plasma; and emitting the droplets from the sample spray into the plasma.

20. A method for analyzing a sample, the method comprising:

atomizing the sample according to the method of claim 19 to produce sample atoms; and measuring an attribute of the sample atoms or photons emitted from the sample atoms.

* * * * *